US011454376B2

(12) United States Patent
Ranieri et al.

(10) Patent No.: US 11,454,376 B2
(45) Date of Patent: Sep. 27, 2022

(54) LUMINAIRE

(71) Applicant: WIVA GROUP S.P.A., Florence (IT)

(72) Inventors: Giuseppe Ranieri, Buje (HR); Marco Angioloni, Bagno A Ripoli (IT); Luigi Trenti, Florence (IT); Gianni Bartolini, Bagno A Ripoli (IT)

(73) Assignee: WIVA GROUP S.P.A., Florence (IT)

( * ) Notice: Subject to any disclaimer, the term of this patent is extended or adjusted under 35 U.S.C. 154(b) by 0 days.

(21) Appl. No.: 17/051,910

(22) PCT Filed: May 2, 2019

(86) PCT No.: PCT/IB2019/053583

§ 371 (c)(1),
(2) Date: Oct. 30, 2020

(87) PCT Pub. No.: WO2019/211780

PCT Pub. Date: Nov. 7, 2019

(65) Prior Publication Data

US 2021/0231295 A1 Jul. 29, 2021

(30) Foreign Application Priority Data

May 2, 2018 (IT) ..... 102018000004998

(51) Int. Cl.
*F21V 15/01* (2006.01)
*F21V 21/04* (2006.01)
(Continued)

(52) U.S. Cl.
CPC ..... *F21V 15/012* (2013.01); *F21V 21/042* (2013.01); *F21W 2131/40* (2013.01); *F21Y 2105/10* (2016.08); *F21Y 2115/10* (2016.08)

(58) Field of Classification Search
CPC ... F21K 9/232; F21V 1/04; F21V 1/06; F21V 1/08; F21V 1/10; F21V 1/12; F21V 29/717; F21V 15/012
See application file for complete search history.

(56) References Cited

U.S. PATENT DOCUMENTS

2007/0091619 A1* 4/2007 Lee ..... F21V 1/06 362/354
2007/0230186 A1* 10/2007 Chien ..... F21V 29/89 362/294

(Continued)

FOREIGN PATENT DOCUMENTS

CN 201772415 U 3/2011
EP 1845305 A1 10/2007

OTHER PUBLICATIONS

International Search Report of the International Searching Authority, dated Jun. 24, 2019 for corresponding PCT patent application No. PCT/IB2019/053583.

*Primary Examiner* — Eric T Eide
(74) *Attorney, Agent, or Firm* — Abelman, Frayne & Schwab

(57) ABSTRACT

A lighting apparatus equipped with an assembly and support system based on a chain device which allows obtaining the lighting apparatus in various shapes and sizes. The chain device comprises a plurality of links adapted to be together or separated and put on site in an easy and quick manner. Said links may comprise the external protective elements which may be applied to give the link and the chain device a greater strength when assembled to form the lighting apparatus.

11 Claims, 10 Drawing Sheets

(51) Int. Cl.

| | |
|---|---|
| *F21Y 105/10* | (2016.01) |
| *F21Y 115/10* | (2016.01) |
| *F21W 131/40* | (2006.01) |

(56) References Cited

U.S. PATENT DOCUMENTS

| | | | | |
|---|---|---|---|---|
| 2009/0261705 | A1* | 10/2009 | Lai | F21V 29/83 313/11 |
| 2010/0002453 | A1* | 1/2010 | Wu | F21V 29/83 362/373 |
| 2017/0016599 | A1 | 1/2017 | Wang | |

* cited by examiner

LUMINAIRE

CROSS REFERENCE TO RELATED APPLICATION

This application claims benefit under 35 U.S.C. § 371 to international application No. PCT/IB2019/053583 filed on May 2, 2019, which claims priority to Italian application No. 102018000004998 filed May 2, 2018, the contents of which are incorporated by reference in their entireties.

FIELD OF THE INVENTION

The present invention relates to the technical field of lighting, in particular the present invention relates to a lighting apparatus and to the components which characterize the aforesaid lighting apparatus.

BACKGROUND ART

Lighting apparatuses, in particular, lighting apparatuses using LED technology light sources, have been known for a long time and have been present on the market for a long time.

Lighting products with variable shapes and sizes, adapted to be installed in the most diverse environments, indoor and outdoor environments, domestic environments, industrial environments, etc., are commercially available.

In particular, in the field of indoor lighting, lighting apparatuses are an important furnishing element and often have particular shapes and designs.

For this reason, these lighting devices, in order to combine the need for particular aesthetic shapes with the need for increasingly high-performing features, often have drawbacks of the constructive type, linked to the need to use suitable molds or particular manufacturing technologies which, ultimately, lead to huge investments both in terms of capital and in terms of construction time and warehouse storage space.

In essence, each new shape which is decided for obtaining a lighting apparatus, even if only slightly different from pre-existing shapes, involves new engineering and the provision of new molds and new lighting bodies.

All of this is aggravated, in particular, when large lighting bodies and shapes are to be achieved.

The need is therefore there to provide a lighting apparatus which overcomes the disadvantages of the lighting apparatuses of the prior art, and which is particularly versatile, flexible, obtainable in any shape and size, aesthetically appealing, easily storable in a warehouse, compact, durable, obtainable at low cost, and made up of components which are easily assembled and configured.

In order to meet this need and overcome the drawbacks set forth in the preceding paragraphs, the lighting apparatus according to the present invention may be obtained in various shapes and sizes, even in bulky and complex shapes, and may be used in any type of application, for indoors or for outdoors and in any type of environment, in domestic installations for private homes but also in public places, commercial establishments, medical offices, offices etc., without requiring the manufacturing of new molds and the fitting of expensive mass production systems.

SUMMARY OF THE INVENTION

It is the object of the present invention to provide a lighting apparatus which overcomes all the disadvantages of the lighting devices of the prior art, so as to allow achieving several shapes and sizes without the need for important cost and time investments for obtaining new molds, and space investments for storing and stocking the apparatuses and the equipment required to produce them.

Furthermore, the apparatus according to the present invention is easily and quickly assembled.

Therefore, the present invention relates to a lighting apparatus in accordance with claim 1, comprising a chain device which allows assembling and obtaining it in various shapes and sizes. The chain device allows assembling the main parts which form said lighting apparatus and comprises a plurality of links adapted to be together or separated and put on site in an easy and quick manner. Said links may comprise the external protective elements which may be applied to give the link and the chain device a greater strength when assembled to form the lighting apparatus.

The dependent claims describe preferred embodiments of the invention, forming an integral part of the present description.

BRIEF DESCRIPTION OF THE DRAWINGS

Further features and advantages of the invention will become more apparent in light of the detailed description of preferred, but not exclusive, embodiments of the apparatus, in particular for lighting, shown by way of explanation but not by way of limitation, with the aid of the accompanying drawings, in which.

Figure 1:
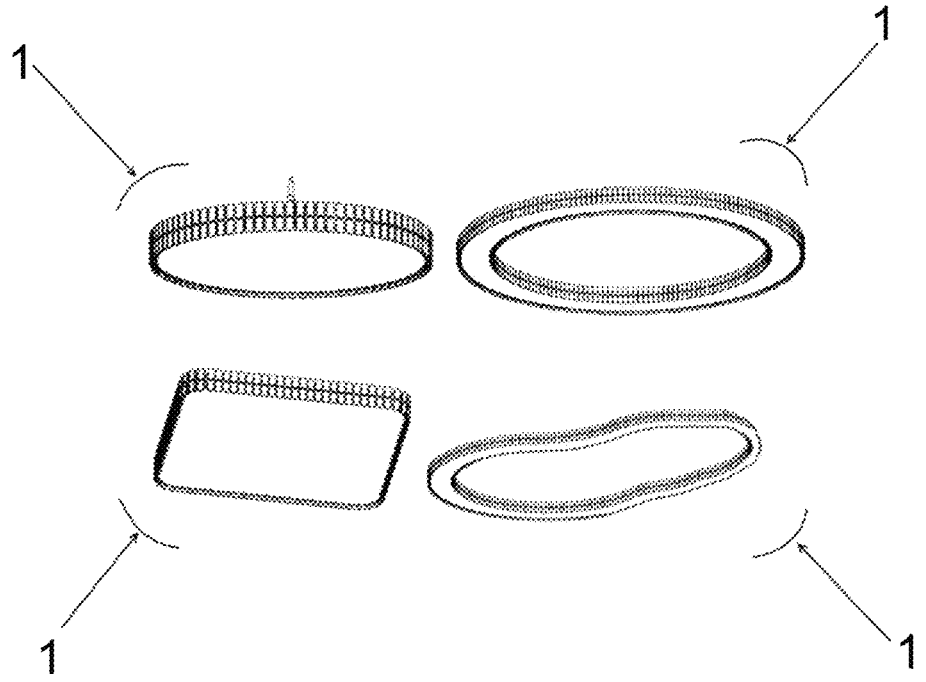
FIG. 1 shows four embodiments of the lighting apparatus according to the present invention.

The component parts of the apparatus according to the present description have been represented in the drawings, where suitable, with conventional symbols, showing only those specific details which are pertinent to the understanding of the embodiments of the present invention, so as not to highlight details which will be immediately apparent, to those skilled in the art, with reference to the description given hereby.

DETAILED DESCRIPTION OF THE INVENTION

Figure 2:
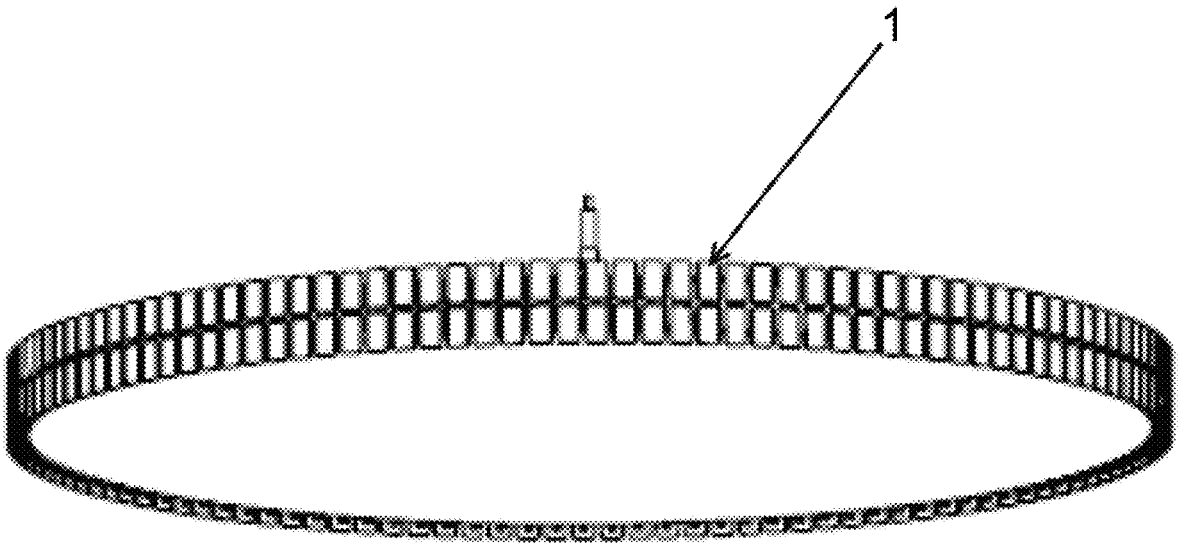
FIG. 2 shows the lighting apparatus according to the present invention having a circular shape and especially adapted for an application in suspension.
Figure 3:
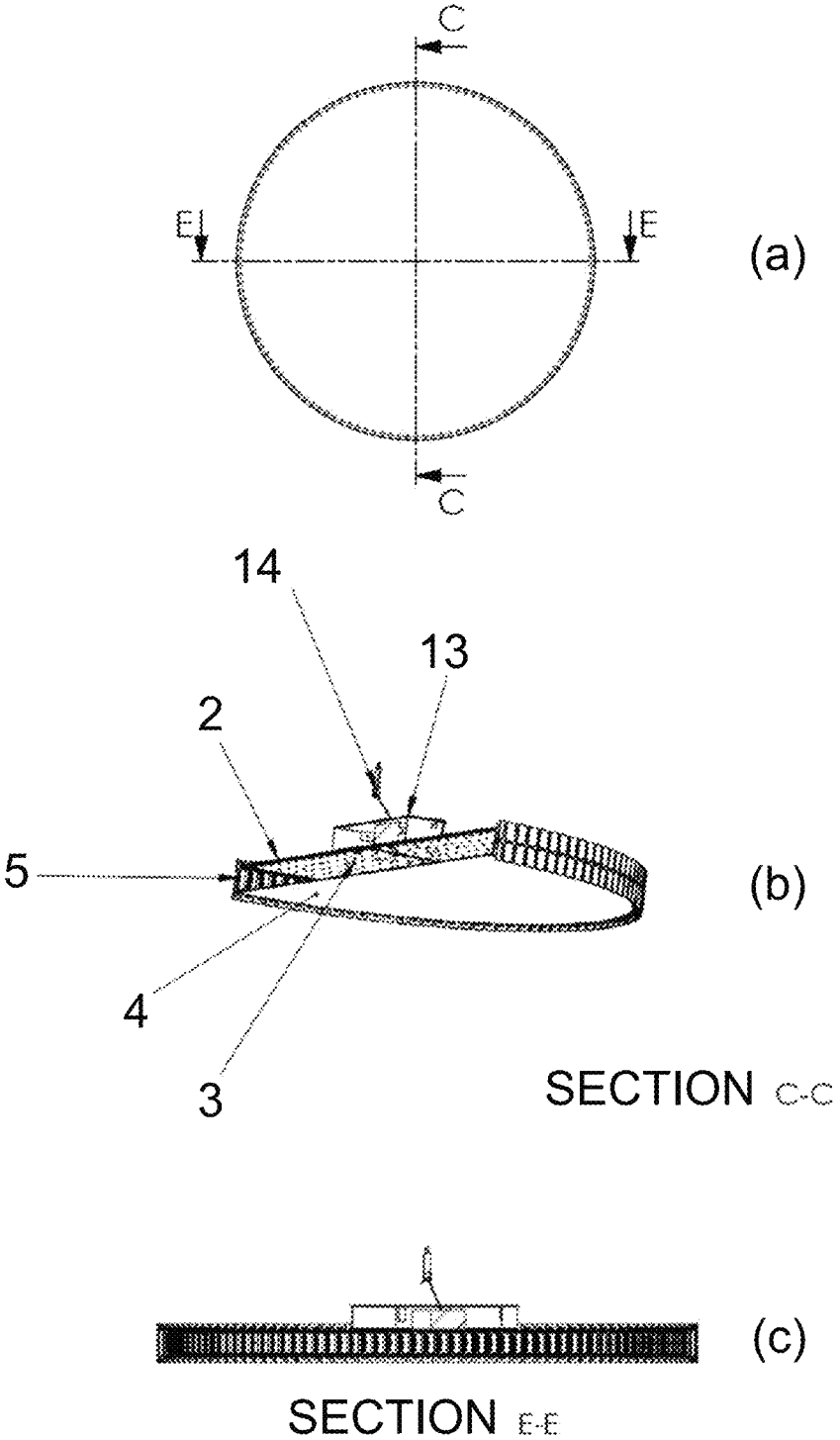
FIGS. 3(*a*), 3(*b*) and 3(*c*) show a detail of the apparatus shown in FIG. 2.
Figure 4:
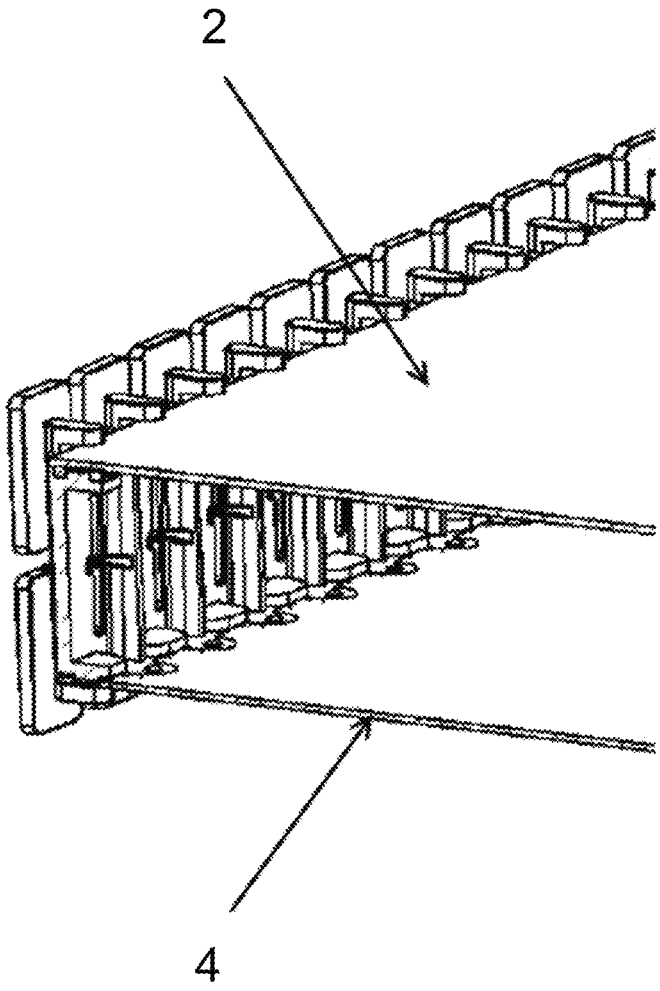
FIG. 4 shows a detail of the lighting apparatus according to the present invention.
Figure 5:
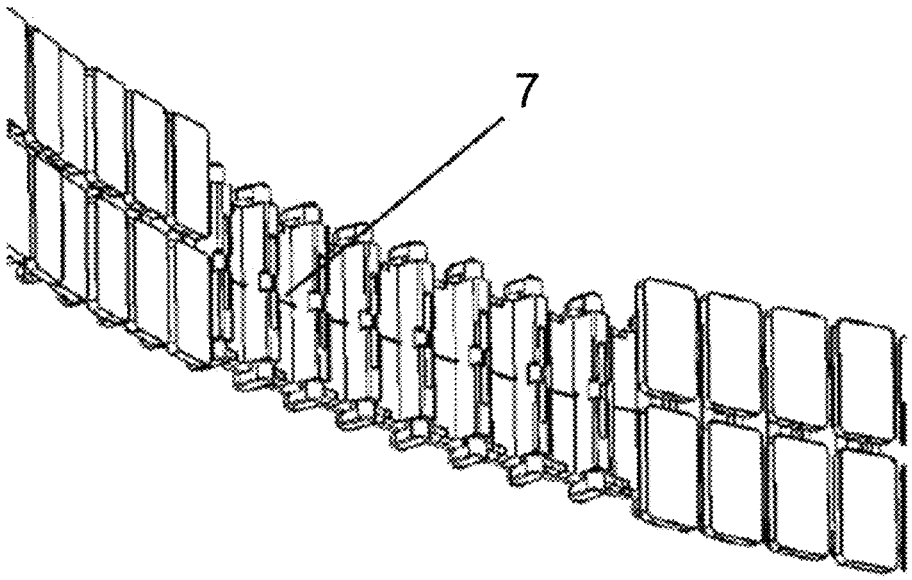
FIG. 5 shows the chain device included in the lighting apparatus of the invention with the possibility of fastening the external protective elements.
Figure 6:
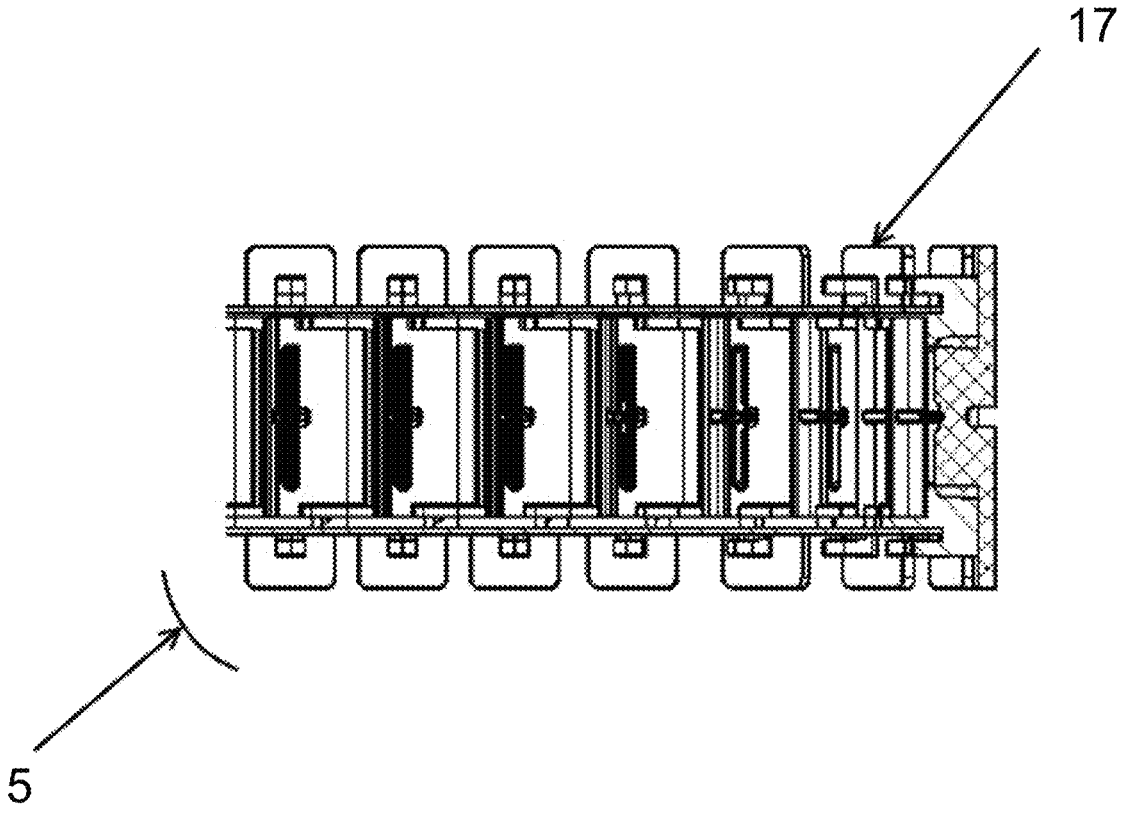
FIG. 6 shows a detail of the chain device included in the lighting apparatus of the invention.

With reference to the accompanying FIGS. 1-4, the lighting apparatus 1, in accordance with the present invention, comprises:

a rear cover 2; at least one light emission device 3, preferably comprising at least one LED; a diffuser screen 4 and an external edge comprising a chain device 5 adapted to be engaged with said rear cover 2 and with said screen 4 so as to rigidly support both.

The rear cover 2, the at least one light emission device 3 and the screen 4 substantially form a sandwich structure, assembled and supported by the chain device 5.

Said chain device 5 comprises, in turn, a plurality of consecutive links 6 adapted to be mutually engaged with one another and associated with at least one clamping means adapted to rigidly clamp the chain device 5 in the desired form.

The rear cover 2 and the screen 4 may have various shapes, such as to be adapted to the different use needs of the lighting apparatus according to the present invention. In the accompanying FIGS. 1 and 2, by way of non-limiting example, lighting apparatuses according to the invention are shown, having the rear cover 2 and the screen 4 of a circular, square shape and delimited by an irregular curve.

The rear cover 2 is conventionally made of plastic or metallic material such as, for example, polycarbonate, aluminum, iron, steel etc., and is suitably associated with means for the mechanical fastening to the ceiling (preferred embodiment as a ceiling light or as a suspension) or to a wall (preferred embodiment as an applique) and with means for dissipating the heat produced by the light emission device 3.

The diffuser screen 4 is preferably made of plastic material such as polycarbonate (PC), polymethylmethacrylate (PMMA) and polystyrene (PS) and may be transparent, opaque, satin-finished, or it may also have a microprismatic surface to suitably filter the emitted light.

The light emission device 3 is preferably based on light emitting diodes (LEDs) and is anchored to the rear cover 2 according to the methods of the prior art.

The light emission device 3 may comprise one or more electronic boards comprising at least one LED light source. Said boards may be made according to the techniques and with the materials used in the prior art, such as, for example, FR4 or the so-called metal core pcb. Said LEDs may advantageously be selected of the high intensity type, for example, of the so-called chip on board (COB) type. Furthermore, the light emission device 3, will comprise suitable light source power supply means. When using LEDs, said power supply means will comprise an electronic power supply with output current regulation provided according to widely known prior art techniques.

The chain device 5 is conventionally made of plastic material and is preferably made of a plastic material selected from the group comprising polycarbonate, methacrylate and abs. Alternatively, the chain device 5 may be made of metallic materials such as, for example, aluminum.

Figure 7:
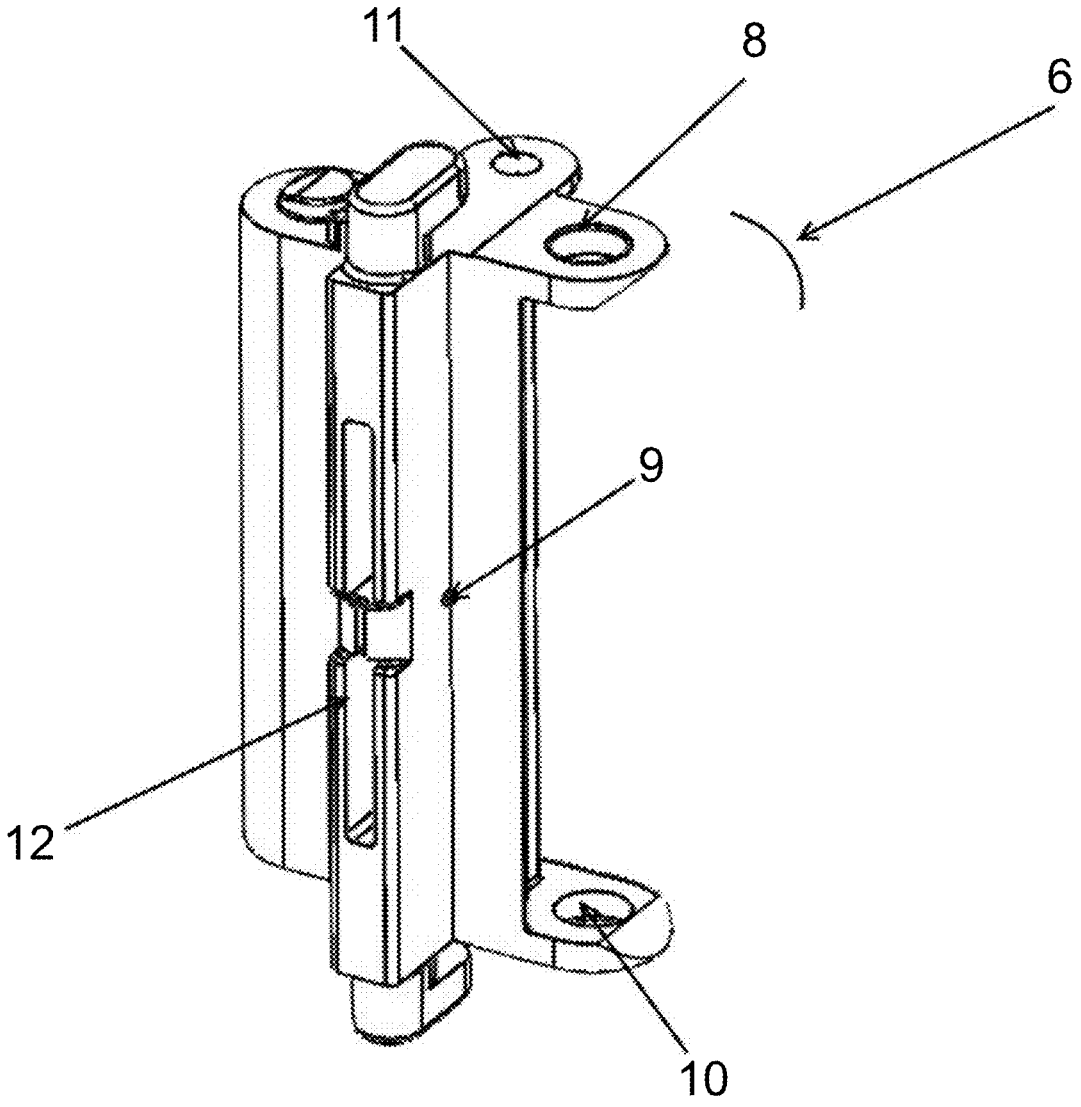
FIGS. 7 to 9 show, in particular, the structure of the link which makes up the chain device forming part of the apparatus according to the present invention.
Figure 8:
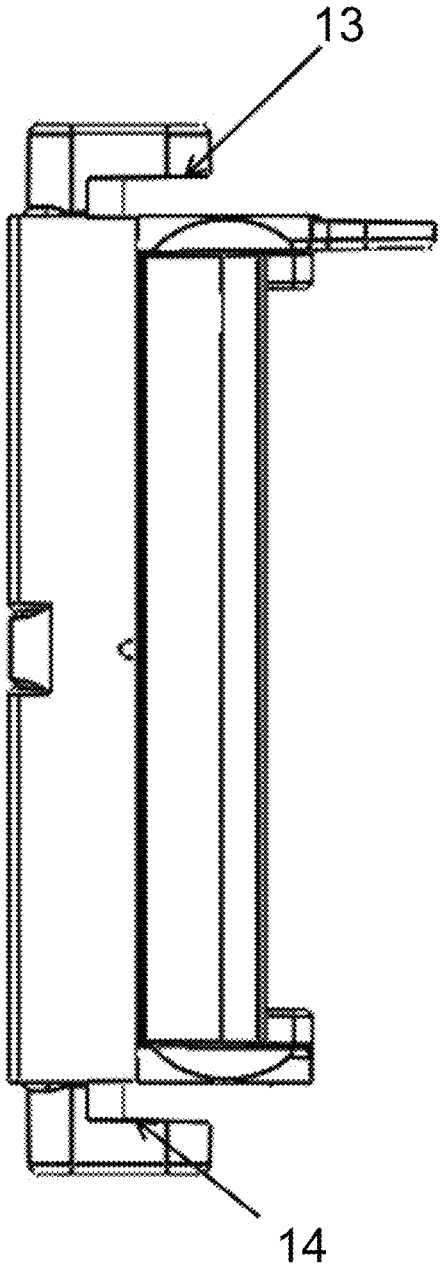
Figure 9:
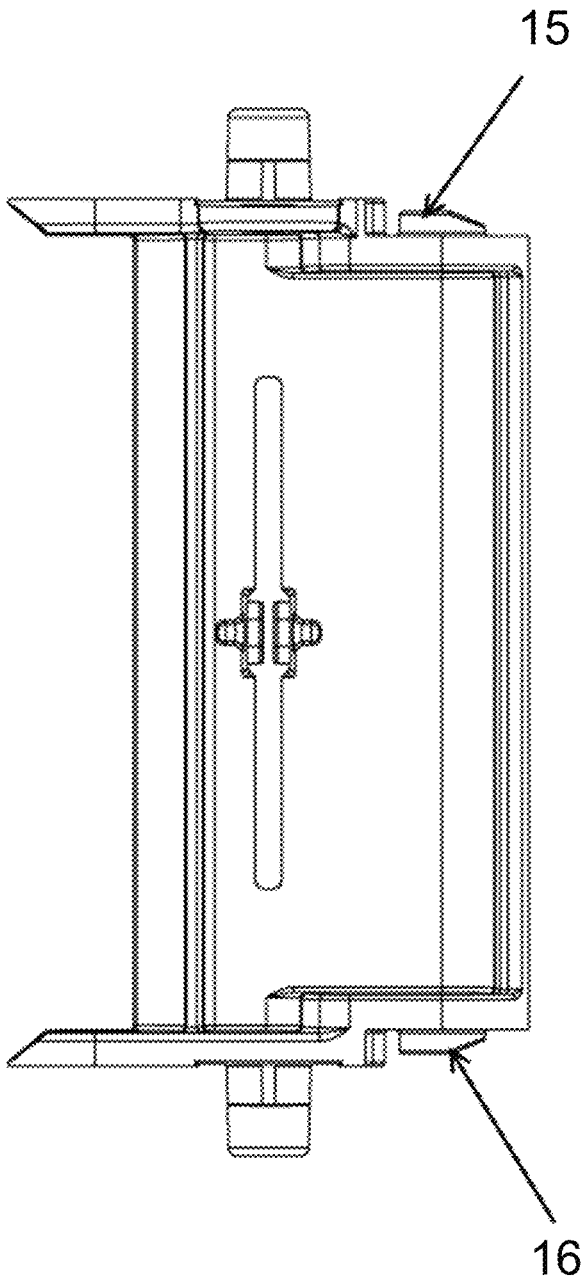
Figure 10:
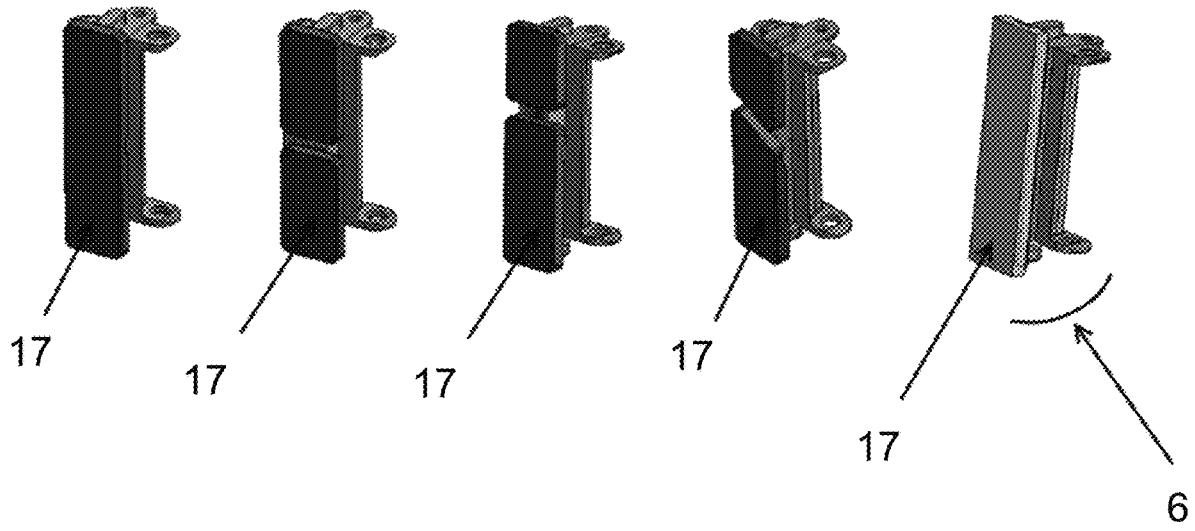
FIG. 10 shows several examples of links equipped with external protective elements of different shapes and sizes.

With reference to the accompanying FIGS. 7 to 10, the links 6 of said chain device 5 have a main body, provided with an upper end and a lower end, and comprise mutual engagement means, adapted to allow said links to be mutually engaged with one another, and clamping means to rigidly clamp the chain device 5 in the desired shape.

Said links 6 of said chain device 5 further comprise means for the engagement with said rear cover 2 and with said screen 4. Preferably, said engagement means comprise a further pair of seats 13, 14 each arranged at one end of the main body of the link 6, having a height slightly higher with respect to the thickness of the rear cover 2 or to the thickness of the screen 4 and a depth adapted to allow the correct support of the rear cover 2 and of the screen 4.

In a preferred embodiment, shown in the accompanying Figures, said mutual engagement means, adapted to allow said links to be mutually engaged with one another, comprise a pair of seats 8, 10, each arranged at one end of the main body of the link 6, and a pair of projections 15, 16 also arranged each at one end of the main body of the link 6 and adapted to be engaged with said seats.

Furthermore, in a preferred embodiment, said clamping means comprise at least one hole 9 passing through the body of said link 6 and a clamping cable adapted to be engaged with said at least one hole 9. Alternatively, or in addition to said through hole 9, said clamping means may comprise a tab 18 slightly projecting from the main body of the link 6 and comprising a hole 11 adapted to be fastened to a similar hole obtained in the rear cover 2 by using, for example, a screw, a rivet, a socket pin, etc.

Alternatively, or additionally, the use of the clamping cable provides for the following. When the chain device 5 is assembled by joining a number of links 6, each of which is engaged by the clamping cable which passes through the hole 9, and the chain device is associated with the other components of the lighting apparatus, it is possible to suitably clamp the chain device by tensioning the clamping cable and fastening the ends thereof so as to maintain the tension of the cable and apply it to the structure of the chain device 5 so as to make it rigid and stable.

Said links 6 of said chain device 5 comprise further means for the engagement with external protective elements 17, for example, of the fastening loops 12 adapted to be engaged with specific pins present on one of the surfaces of the external protective elements 17. A coupling between the slots 12 for fastening the links 6 and the pins of the external protective elements 17 of the snap-in type may be provided in accordance with commonly known methods in use in the prior art.

Said external protective elements 17 may have various shapes and sizes, preferably they are made in a substantially square or rectangular shape. The external protective elements 17 have the function of edging the links of the chain, thus forming a finishing which gives the chain 5 further strength. Said external protective elements 17 may be made of plastic or other suitable materials, such as wood, glass, stone and possibly also of a metal material, such as, for example, aluminum.

The external surface of the external protective elements 17 may possibly be colored or adorned at will with decorations or moldings.

The fastening of the apparatus, according to the present invention, to the ceiling or to the walls may occur with a direct fastening or with a suspension system 14 in a manner known to those skilled in the art. It is also possible to obtain the lighting apparatus according to the present invention so as to be partially recessed into the ceiling, according to methods known in the technical field of lighting systems. The lighting apparatus according to the present invention may be made in various shapes and sizes by virtue of the presence of the chain 5 and of the consecutive links 6 which allow lengths and paths which are such as to be adapted to any need and any type of use. The method for manufacturing the lighting apparatus according to the present invention is definitely simplified since it only requires to provide a chain 5 of a required length via the connection of a number of links 6 comprising suitable means for the engagement with the rear cover 2 and the screen 4, and the subsequent assembly of the back cover 2 and of the screen 4 of the lighting apparatus by means of the chain 5 which is closed by coupling the first and the last link 6 of the chain 5 itself, exploiting the mutual engagement means between said links (6). Furthermore, the method for manufacturing the lighting apparatus according to the present invention may provide for the fastening in position of the links 6 of the chain 5 by means of a clamping cable adapted to be engaged with at least one hole 9 present on each of the links 6 or by means of the fastening of a hole 11, present on at least one link 6 of the chain 5, to a corresponding hole made in the rear cover 2. In this case, the fastening may occur by means, for example, of a screw, a rivet, a socket pin, etc.

The reference to "an embodiment" or "a preferred embodiment" in the above description as a whole means that a particular element or a particular feature or structure described in connection with an embodiment is included in at least one embodiment of the subject described. Therefore, the expression "in an embodiment" or "in a preferred embodiment" in various points of the above description does not necessarily refer to the same embodiment. Furthermore, the particular elements and the particular features or structures described may be combined, in any suitable manner, in one or more embodiments without, however, departing from the scope of protection of the present patent application.

The invention claimed is:

1. A lighting apparatus, comprising:

a rear cover;

at least one light emission device;

a diffuser screen;

assembly and support means comprising a chain device consisting of a plurality of consecutive mechanically interconnected links, each of said links having a body provided with a hole; and a clamping means comprising a clamping cable adapted to engage with said hole.

2. The lighting apparatus according to claim 1, wherein the light emission device comprises at least one light source and power supply means associated with said at least one light source.

3. The lighting apparatus according to claim 2, wherein the light emission device comprises light emitting diodes, LEDs, and the power supply means associated with said at least one light source comprise an electronic power supply with output current regulation.

4. The lighting apparatus according to claim 1, wherein the links of the chain device have a main body provided with an upper end and with a lower end, and comprise mutual engagement means, adapted to allow each link to engage with respective adjacent ones of said links.

5. The lighting apparatus according to claim 4, wherein the mutual engagement means comprise a pair of seats, each arranged at one end of the main body of the link, and a pair of projections each arranged at one end of the main body of the link and adapted to engage with said seats.

6. The lighting apparatus according to claim 1, wherein the links of the chain device comprise further means for the engagement with external protective elements.

7. The lighting apparatus according to claim 6, wherein the further means for the engagement with external protective elements comprise fastening slots adapted to engage with specific pins present on one of the surfaces of the external protective elements.

8. A method for manufacturing a lighting apparatus comprising:

providing a chain comprising a plurality of links having mutual engagement means adapted to allow said links to mutually engage with one another and means for the engagement with a rear cover and with a screen of the lighting apparatus;

assembling the rear cover and the screen of the lighting apparatus by means of the chain;

closing the chain by coupling a first and a last one of the links of the chain by means of said mutual engagement means; and fastening the links of the chain in position by means of a clamping cable adapted to engage with at least one hole present on each of the links.

9. The method according to claim 8, further comprising fastening the links of the chain in position by fastening a hole, present on at least one of the links of the chain, to a corresponding hole provided in the rear cover.

10. The method according to claim 8, wherein said mutual engagement means, adapted to allow said links to mutually engage with one another, comprise a pair of seats arranged at respective ends of a main body of each of the links, and a pair of projections arranged at the respective ends of the main body of each of the links and adapted to engage with said seats.

11. A lighting apparatus, comprising:

a rear cover;

at least one light emission device;

a diffuser screen; and assembly and support means comprising a chain device consisting of a plurality of consecutive mechanically interconnected links, each of said links comprising means for the engagement with the rear cover and with the screen, and wherein said means for the engagement with the rear cover and with the screen comprise a pair of seats each arranged at one end of a main body of the link, having a height slightly higher with respect to the thickness of the rear cover or to the thickness of the screen and a depth adapted to allow the correct support of the rear cover and of the screen.

* * * * *